US008638352B2

(12) United States Patent
Sakamoto

(10) Patent No.: US 8,638,352 B2
(45) Date of Patent: Jan. 28, 2014

(54) EXPOSURE DEVICE INCLUDING AN EXPOSURE UNIT AND AN ELECTRICAL CONNECTION MEMBER AND AN IMAGE FORMING APPARATUS

(75) Inventor: Tetsuya Sakamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 375 days.

(21) Appl. No.: 12/782,489

(22) Filed: May 18, 2010

(65) Prior Publication Data

US 2011/0157295 A1 Jun. 30, 2011

(30) Foreign Application Priority Data

Dec. 25, 2009 (JP) ..... 2009-294707

(51) Int. Cl.
*B41J 2/47* (2006.01)
*B41J 2/435* (2006.01)

(52) U.S. Cl.
USPC ..... 347/237; 347/224

(58) Field of Classification Search
USPC ..... 347/224, 237, 238, 242; 358/1.5; 399/51, 394
See application file for complete search history.

(56) References Cited

U.S. PATENT DOCUMENTS 6,611,280 B1 * 8/2003 Shiraishi et al. ..... 347/238
7,042,591 B1 * 5/2006 Yamazaki et al. ..... 358/1.5
7,542,062 B2 * 6/2009 Sugimoto ..... 347/237
8,040,368 B2 * 10/2011 Yokoi ..... 347/242
2003/0053819 A1 3/2003 Nomura et al.
2004/0135875 A1 * 7/2004 Wakisaka ..... 347/238
2008/0309425 A1 12/2008 Sugita
2009/0169228 A1 * 7/2009 Yokoi et al. ..... 399/51
2010/0214390 A1 8/2010 Tsujino et al.
2010/0238257 A1 * 9/2010 Sakamoto ..... 347/224
2010/0247198 A1 * 9/2010 Saiki et al. ..... 399/394
2011/0261113 A1 10/2011 Sugita

FOREIGN PATENT DOCUMENTS

JP 2000-158749 A 6/2000
JP 2003043776 A 2/2003
JP 2005222752 A 8/2005
JP 2005266353 A 9/2005
JP 2008-080739 A 4/2008
JP 2008290387 A 12/2008
JP 2010197758 A 9/2010

OTHER PUBLICATIONS

Japanese Office Action dated Nov. 5, 2013 for Japanese Patent Application No. 2009-294707.

* cited by examiner

*Primary Examiner* — Stephen Meier
*Assistant Examiner* — Carlos A Martinez
(74) *Attorney, Agent, or Firm* — Sughrue Mion, PLLC

(57) ABSTRACT

An exposure device of an aspect of the present invention includes an exposure unit that is provided between a body to be exposed and a component and that exposes the body to be exposed; and an electrical connection member that is electrically connected to a connecting portion disposed in the exposure unit and includes a first bent portion formed by bending the electrical connection member at an outer side of a clearance between the body to be exposed and the component and a second bent portion formed by bending the electrical connection member on an opposite side of the exposure unit with respect to the first bent portion.

12 Claims, 9 Drawing Sheets

COMPARATIVE EXAMPLE

EXEMPLARY EMBODIMENT

COMPARATIVE EXAMPLE

EXEMPLARY EMBODIMENT

EXPOSURE DEVICE INCLUDING AN EXPOSURE UNIT AND AN ELECTRICAL CONNECTION MEMBER AND AN IMAGE FORMING APPARATUS

CROSS-REFERENCE TO RELATED APPLICATION

This application is based on and claims priority under 35 USC 119 from Japanese Patent Application No. 2009-294707 filed Dec. 25, 2009.

BACKGROUND

Technical Field

The present invention relates to an exposure device and an image forming apparatus.

SUMMARY

An exposure device of an aspect of the present invention includes an exposure unit that is provided between a body to be exposed and a component and that exposes the body to be exposed; and an electrical connection member that is electrically connected to a connecting portion disposed in the exposure unit and includes a first bent portion formed by bending the electrical connection member at an outer side of a clearance between the body to be exposed and the component and a second bent portion formed by bending the electrical connection member on an opposite side of the exposure unit with respect to the first bent portion.

BRIEF DESCRIPTION OF THE DRAWINGS

An exemplary embodiment of the invention will be described in detail with reference to the following figures, wherein.

DETAILED DESCRIPTION

An exposure device and an image forming apparatus pertaining to an exemplary embodiment of the invention will be described.

Figure 1:
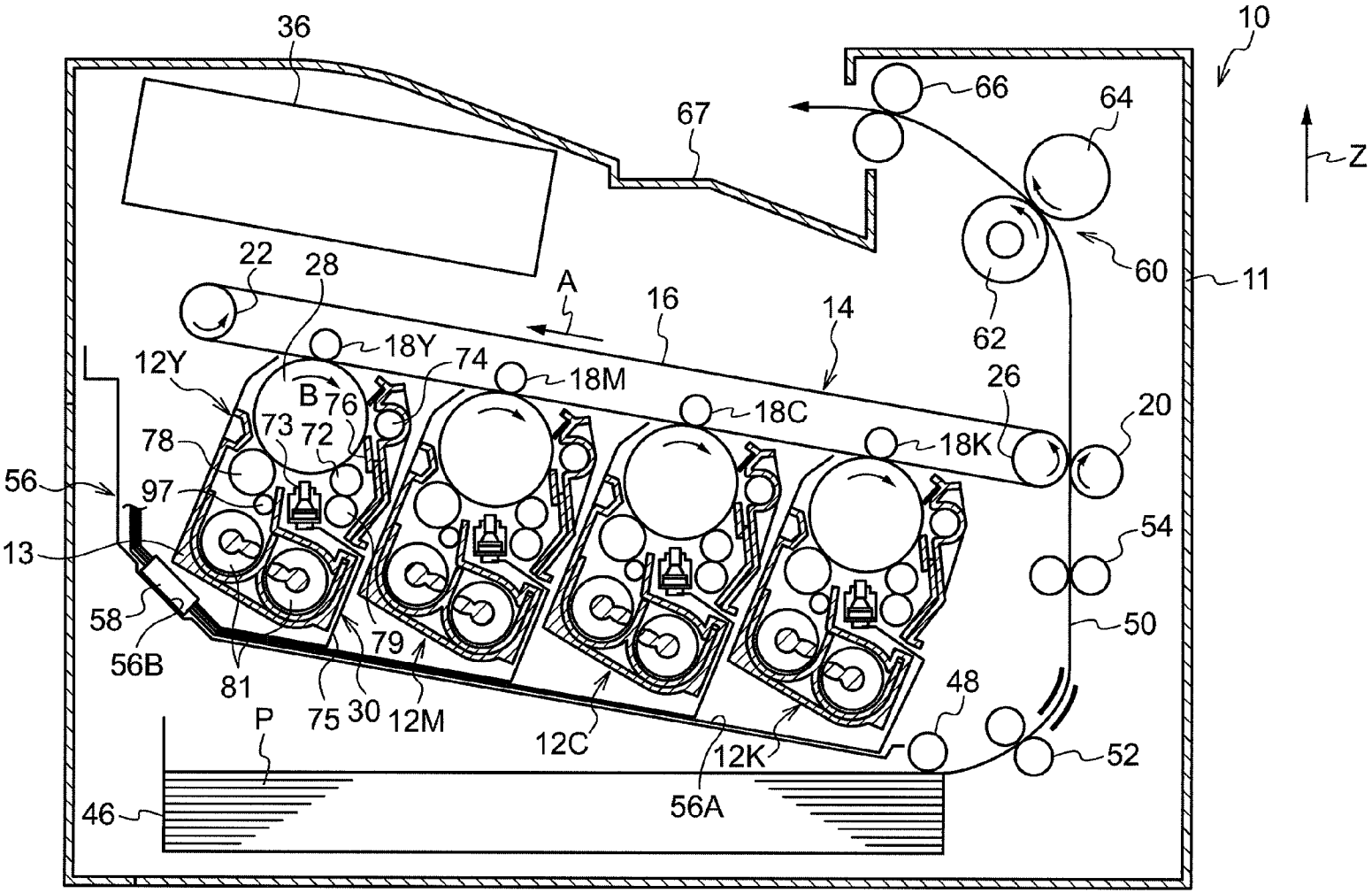
FIG. 1 is an overall diagram of an image forming apparatus pertaining to the exemplary embodiment of the invention.

In FIG. 1, there is shown an image forming apparatus 10 of the exemplary embodiment. In the image forming apparatus 10, as one example, image forming units 12Y, 12M, 12C and 12K serving as one example of image forming units that perform image formation with toners (developers) of the four colors of yellow (Y), magenta (M), cyan (C) and black (K) are arrayed in a diagonal direction (the lower right direction in the drawing) in the center of the inside of a casing 11 that is a body of the apparatus. The image forming units 12 are placed in the order of Y, M, C and K from the upper left to the lower right in the drawing.

The image forming units 12Y, 12M, 12C and 12K have the same configuration except for the toner housed therein. In the following description, the letters Y, M, C and K will be added after numerals when it is necessary to distinguish between the respective colors of yellow, magenta, cyan and black, and the letters Y, M, C and K after numerals will be omitted when it is not necessary to distinguish between the respective colors. The toners of Y, M, C and K are not particularly limited by manufacturing method.

Above the image forming units 12Y, 12M, 12C and 12K, there is disposed a transfer unit 14 that transfers toner images (images) formed by the image forming units 12Y, 12M, 12C and 12K onto recording sheet P. The transfer unit 14 is configured to include a tube shape intermediate transfer belt 16, four first transfer rolls 18Y, 18M, 18C and 18K that are placed on an inner side of the intermediate transfer belt 16 and multiply transfer the toner images of the image forming units 12Y, 12M, 12C and 12K onto the intermediate transfer belt 16, and a second transfer roll 20 that transfers the toner image superimposed on the intermediate transfer belt 16 onto the recording sheet P.

The intermediate transfer belt 16 is wrapped (entrained) around a drive roll 26, which is placed opposing the second transfer roll 20 and is driven by an unillustrated motor, and a support roll 22, which is rotatably supported. The drive roll 26 is driven by the unillustrated motor and rotates, whereby the intermediate transfer belt 16 is circularly moved in the direction of arrow A (a counter clockwise direction in the drawing).

The first transfer rolls 18Y, 18M, 18C and 18K are placed opposing photoreceptors 28 serving as one example of later-described bodies to be exposed of the image forming units 12Y, 12M, 12C and 12K across the intermediate transfer belt 16 therebetween. A transfer voltage of the opposite polarity (in the present exemplary embodiment, a positive polarity as one example) of the toner polarity is applied to the first transfer rolls 18Y, 18M, 18C and 18K. Further, a transfer voltage of the opposite polarity of the toner polarity is also applied to the second transfer roll 20. An unillustrated cleaning device is disposed on the outer peripheral surface of the intermediate transfer belt 16 in a position where the support roll 22 is disposed. Residual toner and paper dust and the like on the intermediate transfer belt 16 are removed by this cleaning device.

Below the image forming units 12, there is disposed a sheet supply component 46 in which the recording sheet P is housed. Further, from an end portion (the right end portion in the drawing) of the sheet supply component 46 upwardly in the vertical direction (the direction of arrow Z), there is disposed a paper transport path 50 on which the recording sheet P is transported.

On the paper transport path 50, there are disposed a feed roll 48 that feeds the recording sheet P from the sheet supply component 46, transport rolls 52 that are configured by a pair of rolls that transport the recording sheet P, and registering rolls 54 that are configured by a pair of rolls that perform matching of the transport timing of the recording sheet P with the moving timing of the image on the intermediate transfer belt 16. Here, the recording sheet P sequentially fed by the feed roll 48 from the sheet supply component 46 is transported on the paper transport path 50 to a second transfer position of the intermediate transfer belt 16 by the registering rolls 54.

On the downstream side of (above) the second transfer roll 20 on the paper transport path 50, there is disposed a fixing unit 60. The fixing unit 60 has a heat roll 62, which is heated by an unillustrated heat source (e.g., a halogen heater), and a pressure roll 64, which sandwiches the recording sheet P between itself and the heat roll 62 and applies pressure to the toner image. Further, on the downstream side of the fixing unit 60 on the paper transport path 50, there are disposed discharge rolls 66 that are configured by a pair of rolls that discharge the recording sheet P after fixing to the outside of the casing 11. The recording sheet P discharged by the discharge rolls 66 lands in a discharge component 67 formed in the upper surface of the casing 11. On the opposite side of the paper transport path 50 inside the casing 11, there is disposed a controller 36 that performs drive control of each portion of the image forming apparatus 10.

Next, the image forming units 12 will be described. Here, the image forming units 12 will be described without distinguishing between the toner colors.

Each of the image forming units 12 has the photoreceptor 28 that is driven to rotate in the direction of arrow B (a clockwise direction in the drawing), a charge roll 72 that contacts and charges the outer peripheral surface of the photoreceptor 28, an exposure unit 73 serving as one example of an exposure unit that irradiates the outer peripheral surface of the photoreceptor 28 with exposure light and forms an electrostatic latent image on the outer peripheral surface of the photoreceptor 28, a developing roll 78 that develops the electrostatic latent image on the outer peripheral surface of the photoreceptor 28 with the toner, an eraser lamp 74 that irradiates the outer peripheral surface of the photoreceptor 28 after transfer with light to perform erasing, and a cleaning blade 76 that cleans the outer peripheral surface of the photoreceptor 28 after erasing. The exposure unit 73 is one component of a later-described exposure device 30.

The charge roll 72, the exposure unit 73, the developing roll 78, the eraser lamp 74 and the cleaning blade 76 face the outer peripheral surface of the photoreceptor 28 and are placed in this order from the upstream side to the downstream side in the direction of rotation of the photoreceptor 28. Further, at the opposite side of the photoreceptor 28 on the outer peripheral surface of the charge roll 72, there is rotatably disposed a cleaning roll 79 that removes an additive and the like of the toner adhering to the outer peripheral surface of the charge roll 72. The charge roll 72 is connected to an unillustrated powering unit, is powered at the time of image formation while driven-rotating, and charges the outer peripheral surface of the photoreceptor 28.

On the lower side of the developing roll 78, there are disposed two helical shaped convey members 81 that stir (mix), and supply to the developing roll 78, the developer (as one example, a mixture of a resin toner and a metal carrier) supplied from an unillustrated toner supply component. Further, a thin layer forming roll 97 is disposed facing the outer peripheral surface of the developing roll 78. The thin layer forming roll 97 is placed, with a distance from the outer peripheral surface of the developing roll 78, on the upstream side of the photoreceptor 28 in the direction of rotation of the developing roll 78, regulates the passage amount of the developer on the outer peripheral surface of the developing roll 78, and forms a developer layer (a thin layer) with a predetermined thickness on the developing roll 78.

The developing roll 78 is configured by a fixed magnet roll (not shown) and a cylindrical developing sleeve (not shown) that is rotatably disposed on the outer side of the magnet roll. A voltage is applied at the time of development such that an electric field is formed between the developing roll 78 and the photoreceptor 28, and the developing roll 78 moves the toner in the developer toward the electrostatic latent image on the photoreceptor 28 while rotating.

Next, the exposure devices 30 will be described.

Figure 2A:
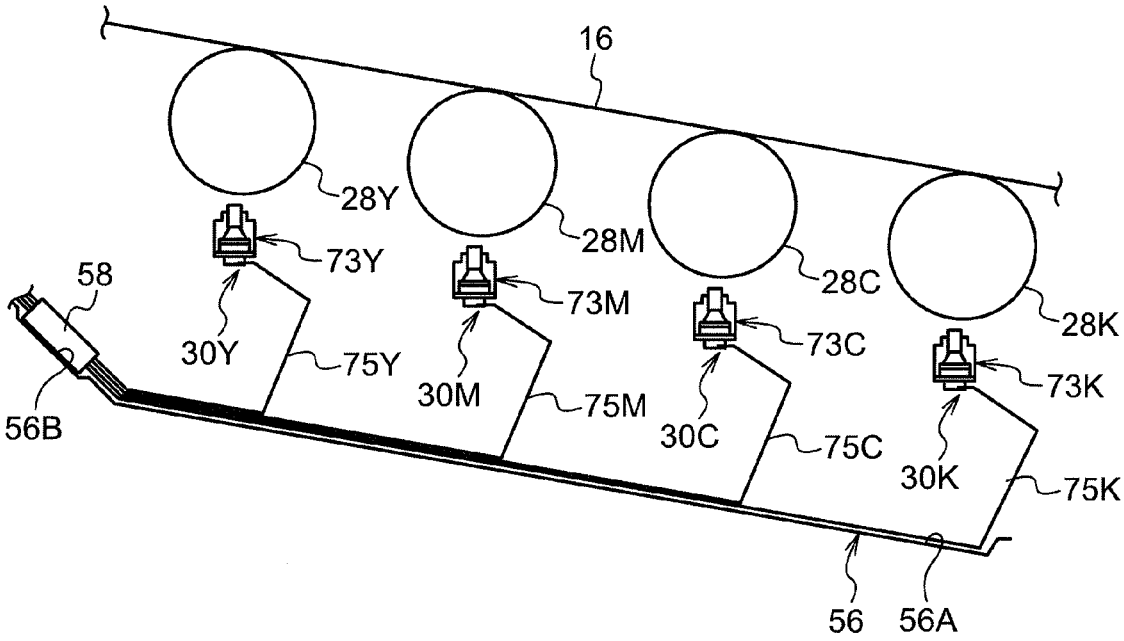
FIG. 2A is a schematic diagram showing a state of placement of plural exposure devices pertaining to the exemplary embodiment of the invention.
Figure 2B:
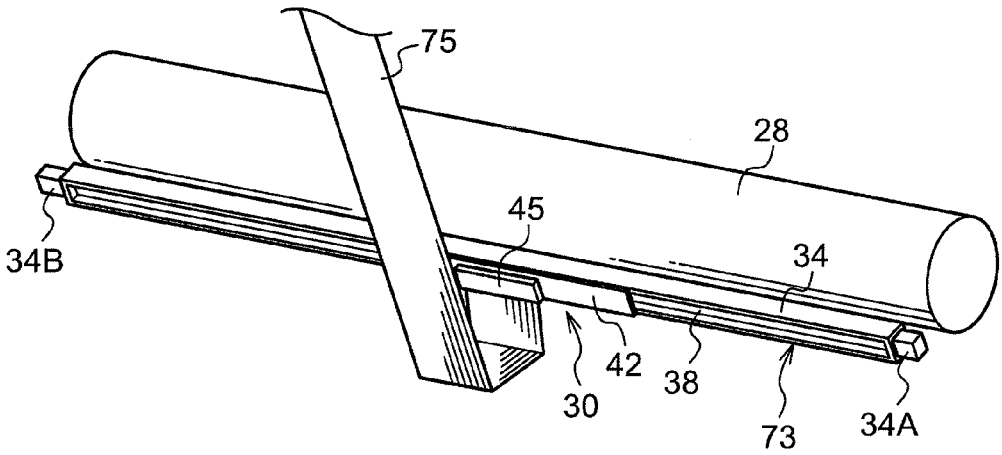
FIG. 2B is a perspective diagram of the exposure device pertaining to the exemplary embodiment of the invention.

As shown in FIG. 2B, each of the exposure devices 30 is configured to include the exposure unit 73 and a flexible flat cable (FFC) 75. The exposure unit 73 has a later-described holder 34. The flexible flat cable (FFC) 75 serves as one example of an electrical connection member, having one end that is electrically connected to a connector 45 serving as one example of a connecting portion provided at the exposure unit 73 and another end that is electrically connected to a later-described drive substrate 32 (see FIG. 3) to enable the supply of electrical power and the transmission of electrical signals to the exposure unit 73. Both longitudinal direction end portions 34A and 34B of the holder 34 of the exposure unit 73 are fixed to a later-described lower housing 13 (see FIG. 1) serving as one example of a part (a component) of the image forming unit 12, and the holder 34 of the exposure unit 73 is held such that its distance from the outer peripheral surface of the photoreceptor 28 becomes a preset distance.

Figure 5:
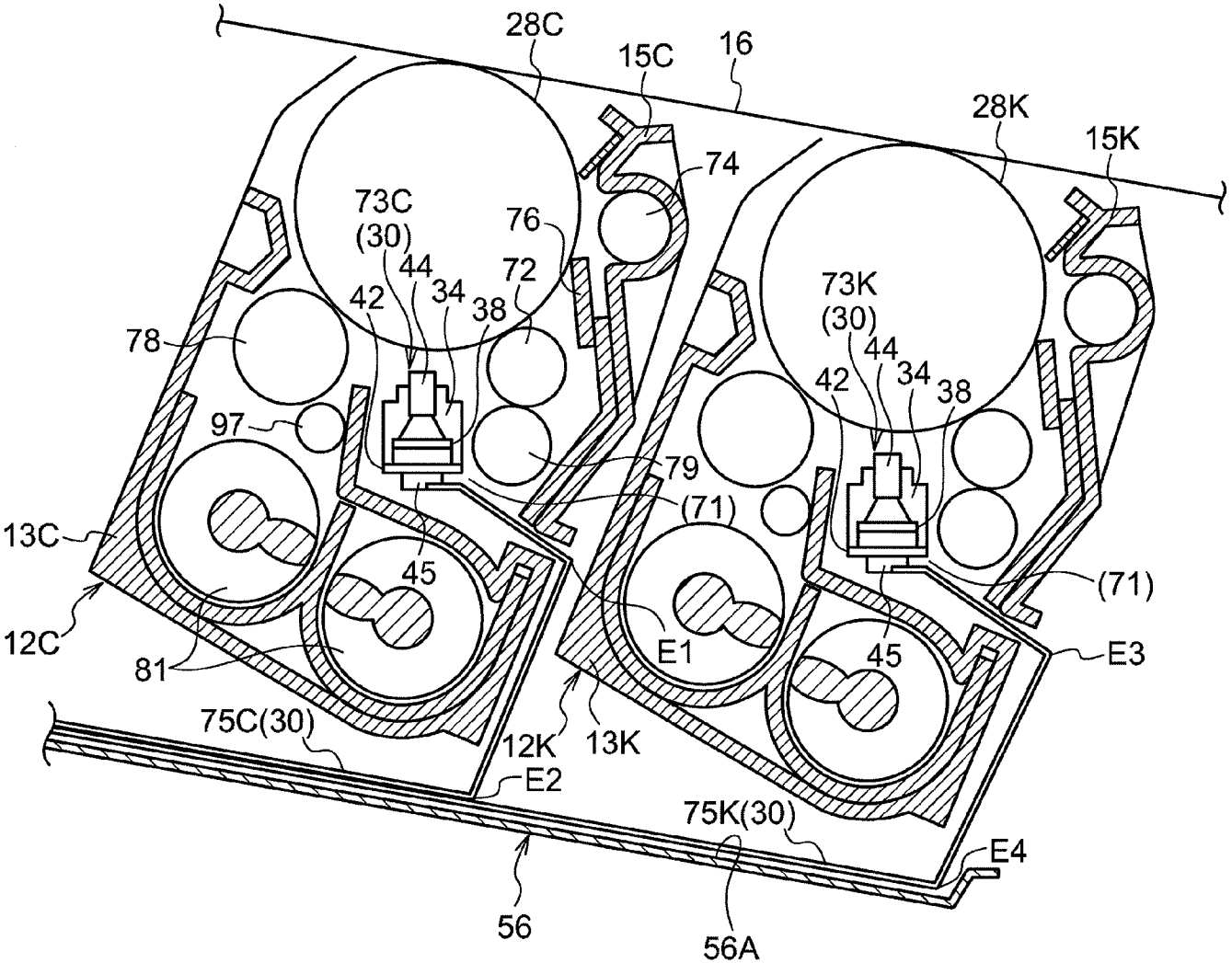
FIG. 5 is a cross-sectional diagram of C and K image forming units pertaining to the exemplary embodiment of the invention.

As shown in FIG. 5, each of the image forming units 12 has a body that is configured by the lower housing 13 and an upper housing 15. In the lower housing 13, there are disposed the developing roll 78, the convey members 81 and the thin layer forming roll 97. In the upper housing 15, there are disposed the photoreceptor 28, the exposure unit 73, the charge roll 72, the cleaning roll 79, the cleaning blade 76 and the eraser lamp 74. Further, the exposure unit 73 has a configuration where a first print board 38, on which a light emitting diode (LED) array (not shown) serving as a light emitting component is disposed, a second print board 42, on which a driver (not shown) that drives the LED array is mounted, and a SELFOC lens array 44, for imaging the light emitted from the LED array on the outer peripheral surface of the photoreceptor 28, are attached to the holder 34 that is the body of the exposure unit 73. The exposure unit 73 is placed in a clearance (space) portion 71 that is between the photoreceptor 28 and the lower housing 13.

The first print board 38 is attached inside the holder 34, with the surface on which the LED array is provided facing the outer peripheral surface of the photoreceptor 28 through an opening formed in the holder 34, and both end portions of the first print board 38 are supported by unillustrated plate springs. Further, the SELFOC lens array 44 is fixed to the opening in the holder 34 and is configured to image the light emitted from the LEDs on the outer peripheral surface of the photoreceptor 28.

The second print board 42 is electrically connected to the first print board 38 by an unillustrated wire, and a driver (not shown) is soldered onto the surface of the second print board 42 on the first print board 38 side. Further, the connector 45 for connecting the one end of the FFC 75 is soldered onto the surface of the print board 42 on the opposite side of the surface to which the driver is attached. The connector 45 is disposed in the longitudinal center of the exposure unit 73.

The FFC 75 has a configuration where plural cables (conductive wires) placed in parallel an interval apart from each other are held in a flexible band-like insulating material member. As one example, there is an FFC where tin-plated copper foil is sandwiched with polyester tape. Further, an unillustrated radio wave shielding member is adhered to the surface of the FFC 75, so the springiness of the FFC 75 is high, and when the FFC 75 is curved, a restoring force that tries to return the FFC 75 to its original flat state acts on the FFC 75.

Figure 3:
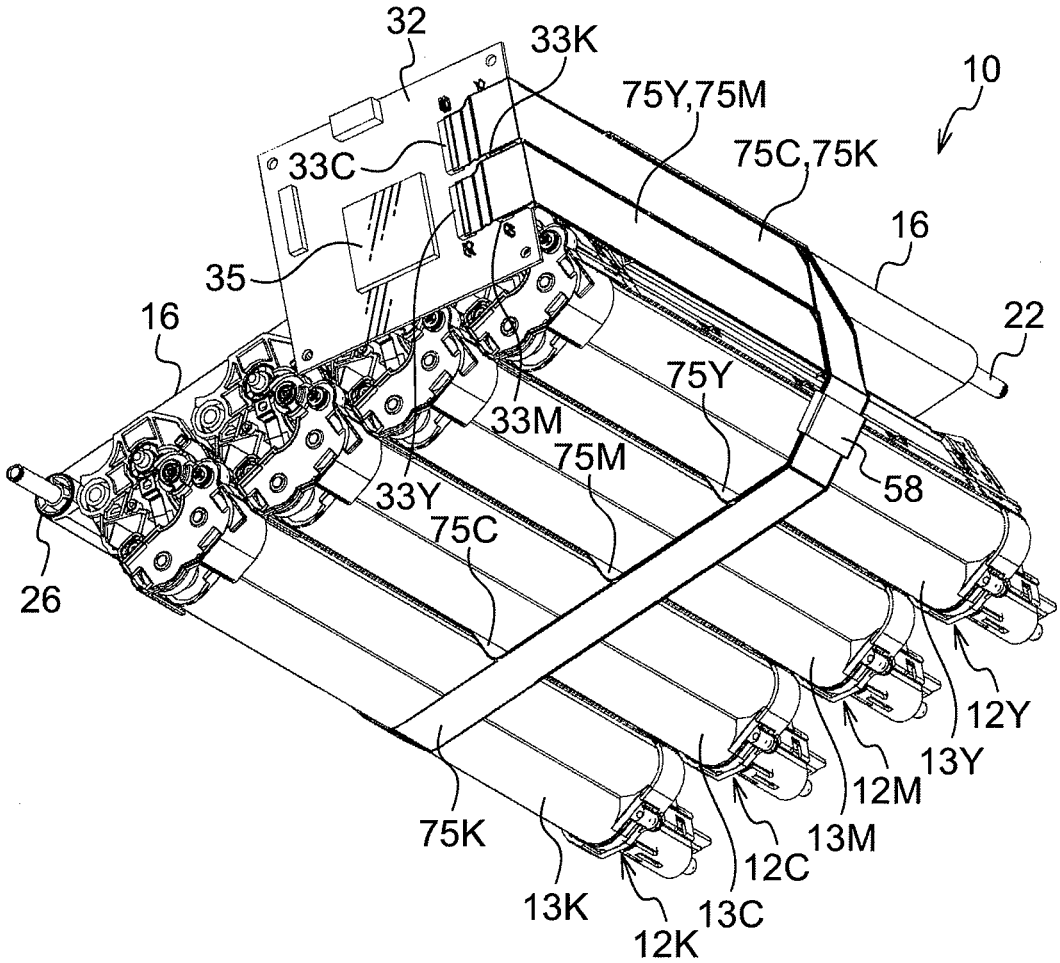
FIG. 3 is a perspective diagram showing a crawl-around state of FFCs in plural image forming units pertaining to the exemplary embodiment of the invention.

As shown in FIG. 2A and FIG. 3, the FFCs 75Y, 75M, 75C and 75K respectively connected to the exposure units 73Y, 73M, 73C and 73K are placed so as to traverse the longitudinal center of the lower housings 13 in a state where they are bent two times from their end portions on the exposure units 73Y, 73M, 73C and 73K sides, and the four FFCs 75Y, 75M, 75C and 75K are together inserted through a ferrite core 58 that is a noise reducing (magnetism shielding) member. FIG. 3 shows a state of placement of the image forming units 12Y, 12M, 12C and 12K and a state of installation of the FFCs 75Y, 75M, 75C and 75K when the image forming apparatus 10 of FIG. 1 is seen in a diagonal direction from its back side.

Figure 4:
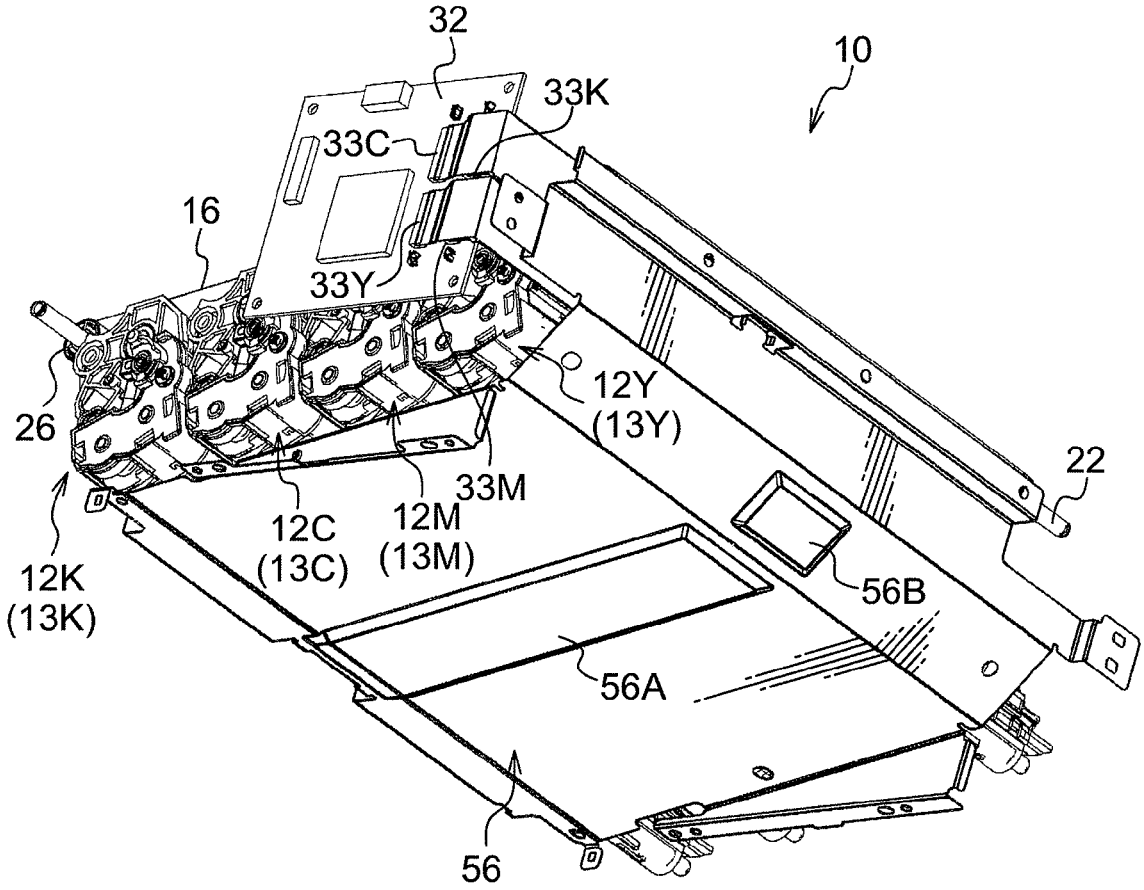
FIG. 4 is a perspective diagram showing a state of attachment of a bottom plate to the plural image forming units pertaining to the exemplary embodiment of the invention.

As shown in FIG. 4, in a site where the image forming units 12Y, 12M, 12C and 12K (the lower housings 13Y, 13M, 13C and 13K) are installed, a bottom plate 56 is disposed so as to cover the bottom surfaces of the image forming units 12Y, 12M, 12C and 12K and a side surface of the image forming unit 12Y. Further, in the bottom plate 56, there are formed groove portions 56A and 56B that open toward the lower housings 13Y, 13M, 13C and 13K, and the FFCs 75Y, 75M, 75C and 75K (see FIG. 3) are placed inside the groove portions 56A and 56B. The aforementioned ferrite core (see FIG. 3) is placed inside the groove portion 56B.

As shown in FIG. 3, the drive substrate 32 is disposed in a position close to the side surfaces on the far side of the image forming units 12Y, 12M, 12C and 12K. The drive substrate 32 includes a controller 35 equipped with a circuit for driving and controlling the drivers of the respective second print boards 42 (see FIG. 5). Four connectors 33Y, 33M, 33C and 33K conductive with the controller 35 are disposed on the surface of the drive substrate 32 on which the controller 35 is mounted. End portions (terminal portions) of the FFCs 75Y, 75M, 75C and 75K inserted through the ferrite core 58 and bent in a direction along the longitudinal direction of the lower housings 13 and bent in a direction along the drive substrate 32 are respectively connected to the four connectors 33Y, 33M, 33C and 33K.

Next, the bent state of the FFCs 75 at the side of the exposure unit 73 will be described.

As shown in FIG. 5, in each of the FFCs 75, a first bent portion E1 is formed on an outer side of a clearance (space) between the photoreceptor 28 and the lower housing 13 (that is, in the vicinity of an end portion (later described "a first corner portion H1) of the lower housing 13 and also at the outside of the lower housing 13, where the FFC 75 passes at extending outside of the lower housing 13), and a second bent portion E2 is formed on an opposite side of the photoreceptor 28 with respect to the first bent portion E1. A "bend (bent)" for the FFC 75 in the present exemplary embodiment means that a bend-line (for example, such as like "crease", "fold-line") remains in the FFC 75 such that the FFC 75 does not return to its original state.

Figure 6:
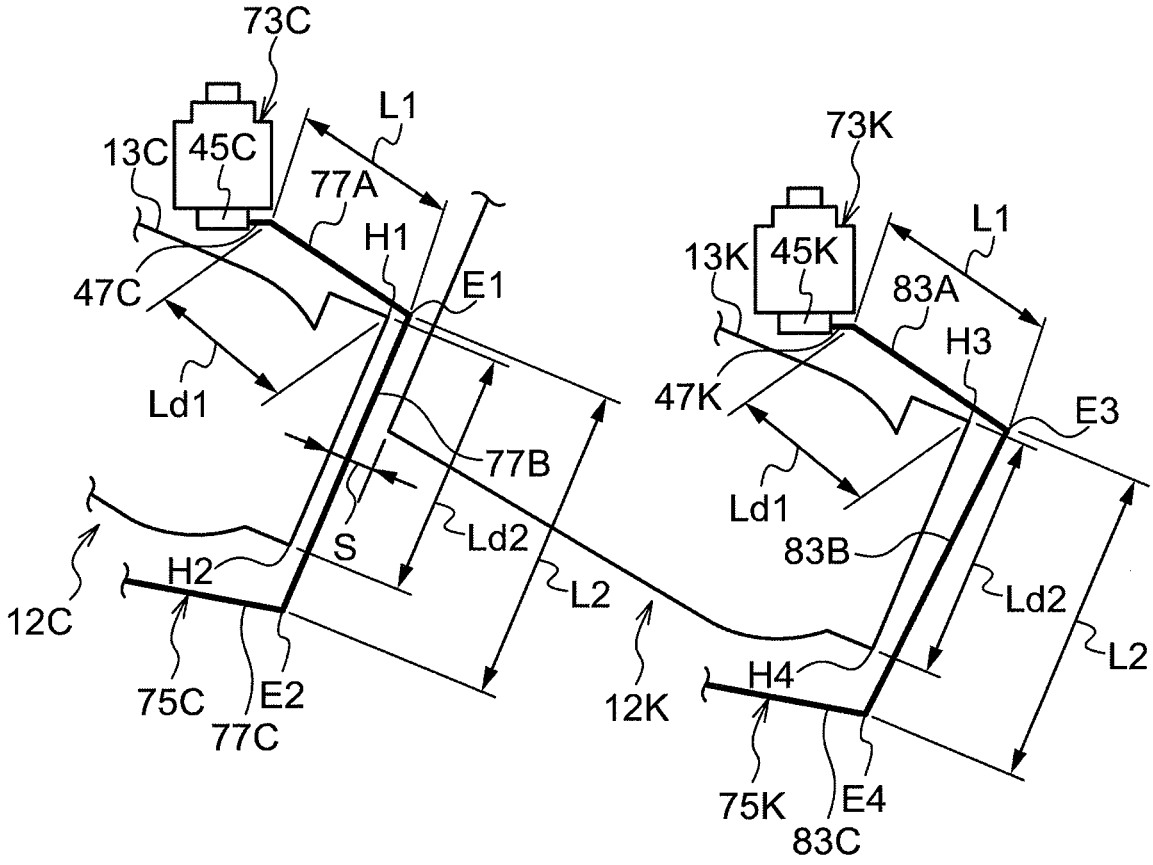
FIG. 6 is a schematic diagram showing a bent state of the FFCs pertaining to the exemplary embodiment of the invention.

Here, in FIG. 6, a state of placement of the exposure units 73C and 73K, the lower housings 13C and 13K, and the FFCs 75C and 75K is shown in a schematic diagram. The members corresponding to the toners of Y and M also have the same configuration, so description will be omitted here.

As shown in FIG. 6, in the lower housing 13C, there is, in a position close to the first bent portion E1 (at the first bent portion E1 side), a first corner portion H1 serving as one example of an end portion of the part. Here, assuming that L1 represents a distance of a first flat portion 77A from a connecting portion 47C that is one end portion of the FFC 75C connected to the connector 45C (the connecting portion 47C also configures part of the connector 45C) to the first bent portion E1, Ld1 represents a distance from the connecting portion 47C to the first corner portion H1, and that S represents an interval between a side wall (the right side surface in the drawing) of the lower housing 13C and a side wall (the left side surface in the drawing) of the lower housing 13K, the first bent portion E1 is formed in a condition where $Ld1<L1<Ld1+S$ is satisfied. Moreover, in the lower housing 13C, a second corner portion H2 serving as one example of an end (another end) portion of the part at the bent-side resulting from the first bent portion E1 (at the opposite side of the connecting portion 47C with respect to the first bent portion E1) is disposed in a position close to the second bent portion E2 (at the second bent portion E2 side). Assuming that Ld2 represents a distance from the first corner portion H1 to the second corner portion H2 and L2 represents a distance of a second flat portion 77B from the first bent portion E1 to the second bent portion E2, the second bent portion E2 is formed in a condition where $Ld2<L2$ is satisfied. A flat portion that is consecutive with the second flat portion 77B in the FFC 75C is a third flat portion 77C.

Similarly, in the lower housing 13K, a first corner portion H3 serving as one example of an end portion of the part is disposed in a position close to the first bent portion E3 (at the first bent portion E3 side). Here, assuming that L1 represents a distance of a first flat portion 83A from a connecting portion 47K that is one end portion of the FFC 75K connected to the connector 45K (the connecting portion 47K also configures part of the connector 45K) to the first bent portion E3 and Ld1 represents a distance from the connecting portion 47K to the first corner portion H3, the first bent portion E3 is formed in a condition where $Ld1<L1$ is satisfied. Moreover, in the lower housing 13K, a second corner portion H4 serving as one example of an end (another end) portion of the part at the bent-side resulting from the first bent portion E3 (at the opposite side of the connecting portion 47K with respect to the first bent portion E3) is disposed in a position close to the second bent portion E4 (at the second bent portion E4 side). Assuming that Ld2 represents a distance from the first corner portion H3 to the second corner portion H4 and L2 represents a distance of a second flat portion 83B from the first bent portion E3 to the second bent portion E4, the second bent portion E4 is formed in a condition where $Ld2<L2$ is satisfied. A flat portion that is consecutive with the second flat portion 83B in the FFC 75K is a third flat portion 83C. Further, the lower housing 13C is placed on the left side of the lower housing 13K in the drawing, but because nothing is placed in a position affecting the FFC 75K on the right side of the lower housing 13K in the drawing, it is possible that L1 of the FFC 75K is larger than L1 of the FFC 75C.

Next, an operation of the exemplary embodiment of the invention will be described.

First, the image forming process of the image forming apparatus 10 will be described.

As shown in FIG. 1, when the units of the image forming apparatus 10 are in an active state, image data subjected to image processing by the controller 36 are converted into color material gradation data of the respective colors and are sequentially outputted to the exposure devices 30. In the exposure devices 30, the exposure units 73 emit exposure lights in accordance with the color material gradation data of the respective colors and expose the outer peripheral surfaces of the photoreceptors 28 charged by the charge rolls 72, whereby electrostatic latent images are formed on the respective photoreceptors 28.

The electrostatic latent images formed on the respective photoreceptors 28 are developed (made visible) as toner images (developer images) of the colors of yellow (Y), magenta (M), cyan (C) and black (K) by the developing rolls 78. Then, the toner images of the respective colors sequentially formed on the photoreceptors 28 of the image forming units 12Y, 12M, 12C and 12K are sequentially multiple-transferred onto the intermediate transfer belt 16 by the four first transfer rolls 18Y, 18M, 18C and 18K.

The toner image of the respective color images being multiple-transferred onto the intermediate transfer belt 16 is second-transferred by the second transfer roll 20 onto the recording sheet P transported from the sheet supply component 46. Then, the toner image of the respective colors on the recording sheet P is fixed by the heat roll 62 and the pressure roll 64 in the fixing unit 60, and the recording sheet P after fixing is discharged into the discharge component 67 by the discharge rolls 66. Further, residual toner and paper dust and the like are removed by the cleaning blades 76 from the outer peripheral surfaces of the photoreceptors 28 after first-transfers of the toner images have ended.

Next, the action of the exposure devices 30 will be described.

Figure 7A:
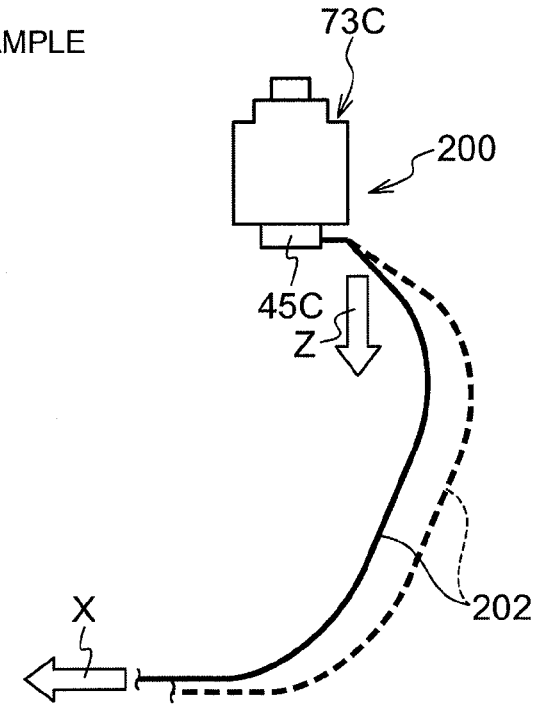
FIG. 7A is a schematic diagram showing a curved state of an FFC pertaining to a first comparative example.

In FIG. 7A, there is shown an exposure device 200 serving as a first comparative example. The exposure device 200 is configured to include the exposure unit 73C and an FFC 202 having one end that is electrically connected to the exposure unit 73C and another end that is connected to the drive substrate 32 (see FIG. 3). The FC 202 is configured by the same member as the aforementioned FFC 75, but it is not bent and is attached in a state where it is curved.

Figure 9:
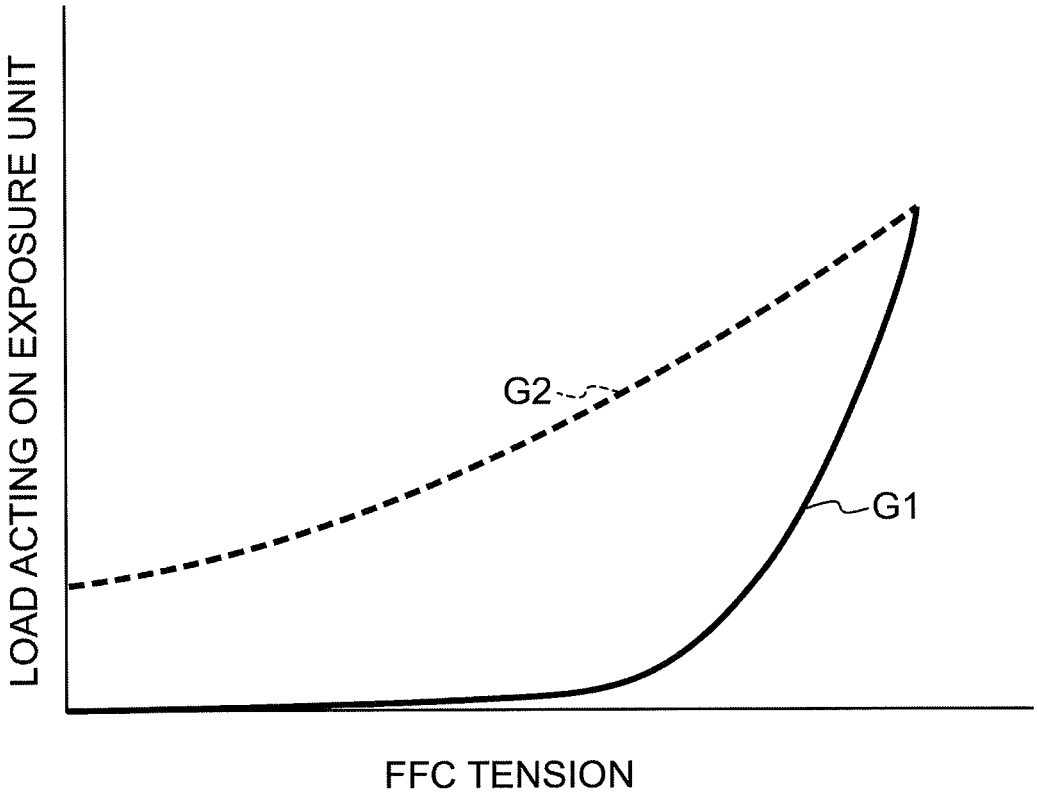
FIG. 9 is a graph showing the relationship between tension of the FFC pertaining to the exemplary embodiment of the invention and a load acting on an exposure unit.

Here, in the exposure device 200, when the FFC 202 is pulled in the direction of arrow X (the left direction in the drawing) at the time when the exposure device 200 is attached to the image forming apparatus 10 (see FIG. 1), a load (see dotted line graph G2 in FIG. 9) in the direction of arrow Z (the down direction in the drawing) acts, from the time pulling starts, on the site where the FFC 202 is connected to the connector 45C because there are no bent portions in the FFC 202 so the springiness of the FFC 202 itself is high. Due to this load, the first print board 38 and the second print board 42 which are inside the exposure unit 73C (see FIG. 5) curve, so, the exposure position in the slow scanning direction (the transport direction of the recording sheet P) and/or the focal point direction (the radial direction of the photoreceptor 28) becomes displaced from the predetermined exposure position, and the image on the recording sheet P becomes disordered. The dotted line represents the original position of the FFC 202, and the solid line represents the position of the FFC 202 after it is pulled in the drawing.

Figure 7B:
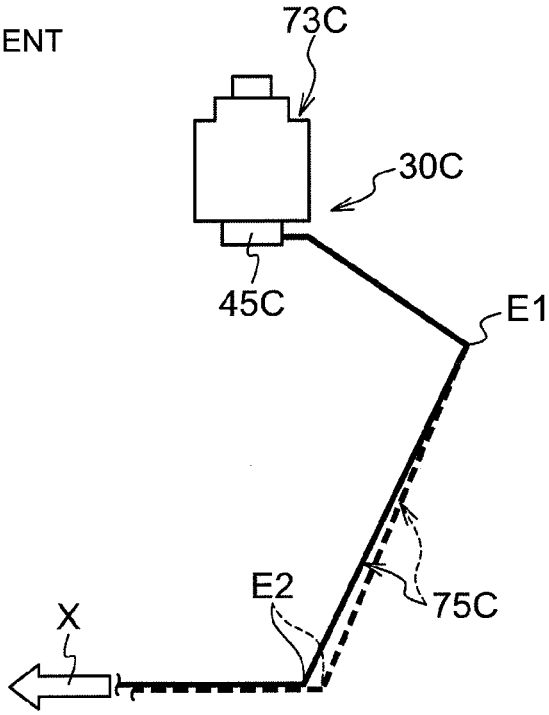
FIG. 7B is a schematic diagram showing the bent state of the FFC pertaining to the exemplary embodiment of the invention.

In contrast, as shown in FIG. 7B, in the exposure device 30C of the present exemplary embodiment (here, only C will be described and description of Y, M and K will be omitted), when the FFC 75C is pulled at the time when the FFC 75C is attached to the image forming apparatus 10 (see FIG. 1), deformation of the FFC 75C is blocked by the first bent portion E1 and the second bent portion E2. That is, springiness is low at the first bent portion E1 and the second bent portion E2, so only the FFC 75C on the side that is being pulled with the first bent portion E1 as a support point (in other words, only a part of the FFC 75C which is the opposite side of the connector 45C with respect to the first bent portion E1) moves, and stress acting from the time pulling starts on the site where the FFC 75C is connected to the connector 45C is reduced as compared to the first comparative example (see solid line graph G1 in FIG. 9). Thus, curving of the first print board 38 and the second print board 42 inside the exposure unit 73 (see FIG. 5) is suppressed, and disorder of the image on the recording sheet P is reduced. The dotted line represents the original position of the FFC 75C, and the solid line represents the position of the FFC 75C after it is pulled in the drawing.

Figure 8A:
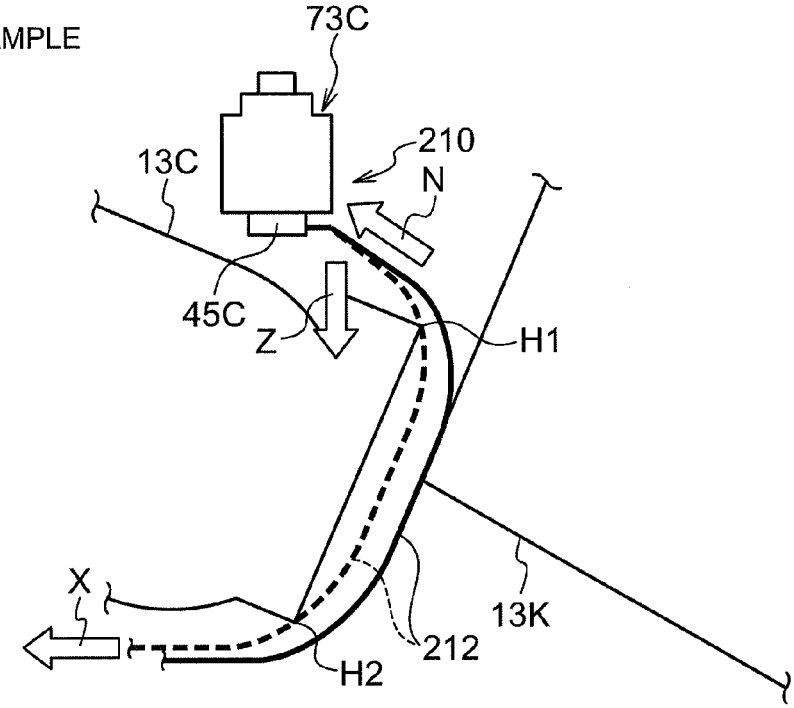
FIG. 8A is a schematic diagram showing a curved state of an FFC pertaining to a second comparative example.

Next, in FIG. 8A, there is shown an exposure device 210 serving as a second comparative example. The exposure device 210 is configured to include the exposure unit 73C and an FFC 212 having one end that is electrically connected to the exposure unit 73C and another end that is connected to the drive substrate 32 (see FIG. 3). The FFC 212 is configured by the same member as the aforementioned FFC 75, but it is not bent and is attached in a state where it is curved. In other words, set positions of bent portions are not managed (not controlled). Further, the lower housing 13K is placed adjacent (next) to the lower housing 13C, and the FFC 212 is placed between the lower housing 13C and the lower housing 13K.

Here, in the exposure device 210, when the FFC 212 is attached in a state where it is curved at the time when the exposure device 210 is attached to the image forming apparatus 10 (see FIG. 1), the FFC 212 contacts the side surface of the lower housing 13K as indicated by the solid line in the drawing, for example, and is pushed in the direction of the connector 45C, and a load in the direction of arrow N (the upper left diagonal direction in the drawing) acts on the site where the FFC 212 is connected to the connector 45C, because set positions of bent portions are not managed. Further, when the FFC 212 is pulled in the direction of arrow X (the left direction in the drawing), a load in the direction of arrow Z (the down direction in the drawing) acts on the site where the FFC 212 is connected to the connector 45C because there are no bent portions in the FFC 212 and the springiness of the FFC 212 itself is high. Due to the load, the first print board 38 and the second print board 42 inside the exposure unit 73C (see FIG. 5) curve, the exposure position in the sub-scanning direction and/or the focal point direction becomes displaced from the predetermined exposure position, and the image on the recording sheet P becomes disordered.

Figure 8B:
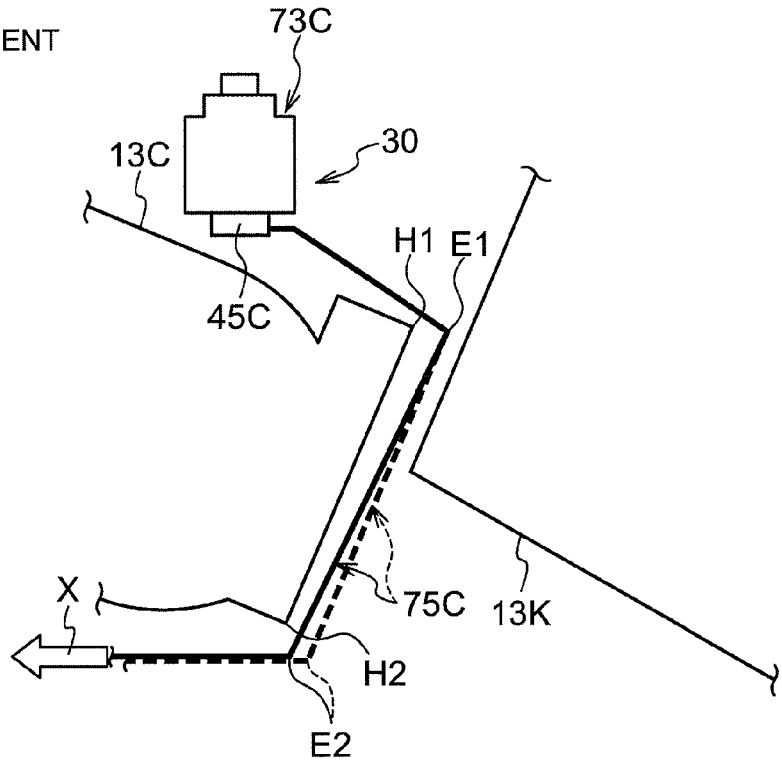
FIG. 8B is a schematic diagram showing the bent state of the FFC pertaining to the exemplary embodiment of the invention.

In contrast, as shown in FIG. 8B, in the exposure device 30C of the present exemplary embodiment (here, only C will be described and description of Y, M and K will be omitted), the set position of the first bent portion E1 is managed (controlled) such that $Ld1<L1<Ld1+S$ (see FIG. 5) as mentioned above, so the FFC 75C is placed between the lower housing 13C and the lower housing 13K without contacting the lower housings 13C and 13K. For this reason, stress acting on the site where the FFC 75C is connected to the connector 45C is reduced as compared to the comparative example.

Moreover, in the exposure device 30C of the present exemplary embodiment, the set position of the second bent portion E2 is managed (controlled) such that $Ld2<L2$ (see FIG. 5), so when the FFC 75C is pulled in the direction of arrow X (the left direction in the drawing), it is difficult for the FFC 75C to contact the second corner portion H2 of the lower housing 13C. For this reason, stress acting on the site where the FFC 75C is connected to the connector 45C is reduced as compared to the second comparative example. Thus, curving of the first print board 38 and the second print board 42 inside the exposure unit 73 (see FIG. 5) is suppressed, and disorder of the image on the recording sheet P is reduced.

The invention is not limited to the exemplary embodiment described above.

The number of places where the bent portions are formed in the FFC 75 around each of the lower housings 13 may also be three or more plural places. Further, the image forming units 12Y, 12M, 12C and 12K may also be arranged in a horizontal direction or a vertical direction rather than being arranged in a diagonal direction. Moreover, the body of each of the image forming units 12 is not necessary to be divided into the upper housing 15 and the lower housing 13, that is, it may also be configured integrally. Further, the electrical connection member is not limited to the FFC 75 and may also use a cable with high springiness. Moreover, as for the first flat portions 77A and 83A, the second flat portions 77B and 83B, and the third flat portions 77C and 83C, not only may they be bent so as to form a cross-sectional U-shape, but the third flat portions 77C and 83C may also be directed toward the opposite sides of the first flat portions 77A and 83A.

What is claimed is:

1. An exposure device comprising:

an exposure unit that is provided between a body to be exposed and a component and that exposes the body to be exposed;

a bottom plate member which is provided so as to cover the component;

a housing comprising an upper housing portion and the component as a lower housing portion; and an electrical connection member that is electrically connected to a connector disposed in the exposure unit and includes a first portion, a second portion, and a third portion, wherein the first portion and the third portion are arranged at opposite sides of the component, and the second portion is connected between the first portion and the third portion at first and second bent portions, wherein the component is disposed outside of the exposure unit, wherein the first portion has a first end electrically connected to the connector and a second end that passes through a gap between the lower housing portion and the upper housing portion such that the first bent portion is disposed outside of the housing, wherein a groove portion that opens toward the component is formed in the bottom plate member, and wherein the third portion of the electrical connection member is placed inside the groove portion.

2. The exposure device of claim 1, wherein when seen from a width direction of the electrical connection member, L1 represents a distance from the connector to the first bent portion and Ld1 represents a distance from the connector to an end portion of the component, the first bent portion is formed such that the condition Ld1<L1 is satisfied.

3. The exposure device of claim 2, wherein another component is provided on an opposite side of the electrical connection member, and S represents a distance between a wall of the component and a wall of another component, the first bent portion is formed such that the condition Ld1<L1<Ld1+S is satisfied.

4. The exposure device of claim 3, wherein when seen from the width direction of the electrical connection member, Ld2 represents a distance from a first corner portion which is the end portion of the component at the first bent portion side and a second corner portion which is an end portion of the component at the second bent portion side and L2 represents a distance from the first bent portion to the second bent portion, the second bent portion is formed such that the condition Ld2<L2 is satisfied.

5. The exposure device of claim 3, wherein another exposure unit is provided between another body to be exposed and the another component.

6. The exposure device of claim 2, wherein when seen from the width direction of the electrical connection member, Ld2 represents a distance from a first corner portion which is the end portion of the component at the first bent portion side and a second corner portion which is an end portion of the component at the second bent portion side and L2 represents a distance from the first bent portion to the second bent portion, the second bent portion is formed such that the condition Ld2<L2 is satisfied.

7. The exposure device of claim 1, wherein the electrical connection member is bent to form the first bent portion and the second bent portion such that a shape of the electrical connection member does not return to a shape before bending.

8. The exposure device of claim 7, wherein the electrical connection member is bent to form the first bent portion and the second bent portion such that, at the electrical connection member, a portion between the connector and the first bent portion is made to be flat and a portion between the second bent portion and the first bent portion is made to be flat.

9. The exposure device of claim 1, wherein the body, the exposure unit, and the connector are disposed in the upper housing portion.

10. The exposure device of claim 1, wherein the second bent portion is disposed outside of the housing and below the lower housing portion.

11. An exposure device comprising:

a body to be exposed;

an exposure unit that exposes the body to be exposed;

a housing that houses the exposure unit and the body to be exposed, the exposure unit being provided between the body to be exposed and a portion of the housing;

a bottom plate member which is provided so as to cover the portion of the housing; and an electrical connection member, one end portion of which is electrically connected to a connector disposed in the exposure unit and another end portion of which extends outside the portion of the housing from a clearance between the body to be exposed and the portion of the housing, the electrical connection member including a first portion, a second portion, and a third portion, wherein the first portion and the third portion are arranged at opposite sides of the housing, and the second portion is connected between the first portion and the third portion at first and second bent portions, wherein the housing is disposed outside of the exposure unit, wherein the housing comprises an upper housing portion and the portion of the housing as a lower housing portion, wherein the first portion has a first end electrically connected to the connector and a second end that passes through a gap between the lower housing portion and the upper housing portion such that the first bent portion is disposed outside of the housing, wherein a groove portion that opens toward the portion of the housing is formed in the bottom plate member, and wherein the third portion of the electrical connection member is placed inside the groove portion.

12. An image forming apparatus comprising image forming units, each of which includes:

an exposure device including:

an exposure unit that is provided between a body to be exposed and a component and that exposes the body to be exposed;

a bottom plate member that is provided so as to cover the image forming units;

a housing comprising an upper housing portion and the component as a lower housing portion; and an electrical connection member that is electrically connected to a connector disposed in the exposure unit and includes a first portion, a second portion, and a third portion, the body to be exposed being an image carrier whose outer peripheral surface is exposed by the exposure unit and which holds a latent image formed by exposure;

a developing unit that develops the latent image on the image carrier with developer, and a transfer unit that transfers a developer image developed by the developing unit onto a transfer material transported toward the outer peripheral surface of the image carrier;

a plurality of the image forming units being arranged in a transport direction of the transfer material, wherein the first portion and the third portion are arranged at opposite sides of the component, and the second portion is connected between the first portion and the third portion at first and second bent portions, wherein the component is disposed outside of the exposure unit, wherein the first portion has a first end electrically connected to the connector and a second end that passes through a gap between the lower housing portion and the upper housing portion such that the first bent portion is disposed outside of the housing, wherein the transfer unit is placed on an upper side of the image carrier, and wherein a groove portion that opens toward the components is formed in the bottom plate, and the electrical connection members of the image forming units are placed in a superimposed manner inside the groove portion.

* * * * *